US007780325B2

(12) United States Patent
Collomb et al.

(10) Patent No.: US 7,780,325 B2
(45) Date of Patent: Aug. 24, 2010

(54) LUMINOUS TURNING BUTTON

(75) Inventors: Virginie Collomb, Grenoble (FR); Claude Rousseau, Roullet-Saint-Estephe (FR); Alain Tardivon, Rouillac (FR); Patrice Thizon, Rouelle-sur-Touvre (FR)

(73) Assignee: Schneider Electric Industries SAS, Rueil-Malmaison (FR)

( * ) Notice: Subject to any disclaimer, the term of this patent is extended or adjusted under 35 U.S.C. 154(b) by 232 days.

(21) Appl. No.: 10/582,941

(22) PCT Filed: Dec. 16, 2004

(86) PCT No.: PCT/EP2004/053549

§ 371 (c)(1),
(2), (4) Date: Jun. 15, 2006

(87) PCT Pub. No.: WO2005/069326

PCT Pub. Date: Jul. 28, 2005

(65) Prior Publication Data

US 2007/0147063 A1 Jun. 28, 2007

(30) Foreign Application Priority Data

Dec. 17, 2003 (FR) ..... 03 14775
Dec. 17, 2003 (FR) ..... 03 14779

(51) Int. Cl.
*F21V 8/00* (2006.01)

(52) U.S. Cl. ..... 362/551; 362/29; 362/30

(58) Field of Classification Search ..... 362/551, 362/29, 30, 282; 200/310–316; 116/310, 116/DIG. 29, 202
See application file for complete search history.

(56) References Cited

U.S. PATENT DOCUMENTS

| | | | | |
|---|---|---|---|---|
| 2,693,165 | A * | 11/1954 | Appleman | 116/310 |
| 3,421,474 | A * | 1/1969 | Demi | 116/277 |
| 5,687,834 | A | 11/1997 | Simon et al. | |
| 5,845,365 | A | 12/1998 | Howie, Jr. | |
| 5,913,414 | A | 6/1999 | Pollock et al. | |
| 6,860,224 | B2 * | 3/2005 | Snider | 116/310 |

FOREIGN PATENT DOCUMENTS

| | | |
|---|---|---|
| WO | 01/48769 | 7/2001 |
| WO | WO 2004/104720 | * 12/2004 |

* cited by examiner

*Primary Examiner*—Sharon E Payne
(74) *Attorney, Agent, or Firm*—Oblon, Spivak, McClelland, Maier & Neustadt, L.L.P.

(57) ABSTRACT

A luminous turning button for an electric circuit, including a handle mounted to pivot about an axis to actuate at least one electric switch unit and that is illuminated by a light source substantially disposed along the axis. The handle includes a cap forming a disk and a gripping tab that protrudes in a diametral plane. The cap is made of translucent or transparent material capable of allowing the light to travel to the outside, the gripping tab being hollow and covering an integrated mechanical base made of opaque material.

13 Claims, 3 Drawing Sheets

LUMINOUS TURNING BUTTON

FIELD OF THE INVENTION

The present invention relates to a luminous turning button for an electric circuit comprising a handle that is mounted so as to pivot about an axis to actuate at least one electric switch unit and is illuminated by a light source substantially disposed along the axis, the handle comprising a cap forming a disk and a gripping tab that protrudes in a diametral plane.

DISCUSSION OF THE BACKGROUND

Luminous turning buttons are known that have a handle suitable for turning about an axis with a limited angular movement, in order to adopt at least two positions. The handle allows the light originating from a central light source to pass through and is provided with control members to switch the electric units. The color of the light emitted by the button may be chosen by the user, for example according to the function assigned to the button. The seal of the turning portion of such a luminous turning button is provided by a lip seal that induces a resistant force.

Document US 2003/0150701 describes a turning button having a luminous pointer.

SUMMARY OF THE INVENTION

The object of the invention is to provide a luminous turning button whose handle has a luminosity on the thin rims and on the side faces of the tab. The handling and sealing conditions of the luminous turning button are improved.

According to one feature, the cap is made of translucent or transparent material capable of allowing the light to travel to the outside, the gripping tab being hollow, and covers an integrated mechanical base made of opaque and mechanically strong material.

According to another feature, the button comprises, in the handle, a light guide conducting the light from the source from beneath the base to the hollow space of the tab.

According to another feature, the mechanical base of generally annular shape, has on the underside at least one actuation member interacting with a mechanism.

According to another feature, the light guide has a light entrance face, traverses the annular-shaped base via a central orifice aligned with the axis and has a light emitter in the hollow internal space of the tab in order to diffuse the light to the sides.

According to another feature, the light emitter housed in the hollow space of the tab is shaped like a prism and receives the light from a light entrance unit attached to the bottom of the handle.

Other features and advantages are the subject of the appended subsidiary claims.

DESCRIPTION OF THE DRAWINGS

The following detailed description, with reference to the appended drawings, illustrates embodiments given as examples.

DESCRIPTION OF THE PREFERRED EMBODIMENTS

Figure 1:
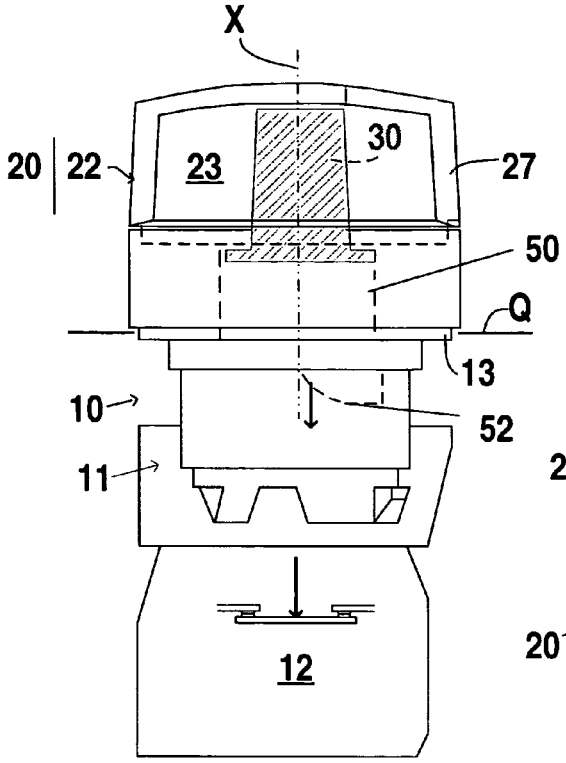
FIG. 1 is a diagram, in side view, of the luminous turning button according to the invention.
Figure 2:
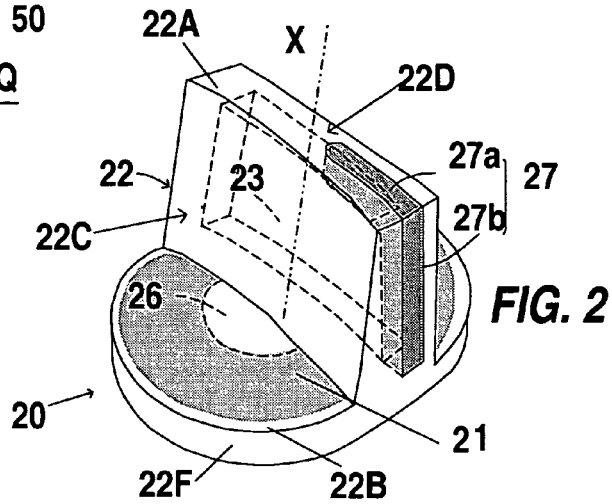
FIG. 2 illustrates, in perspective, an embodiment of the handle of the button.
Figure 4:
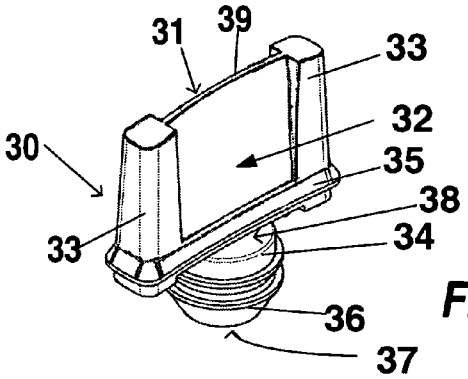
FIG. 4 illustrates, in perspective, the light guide incorporated into the luminous button.

The luminous turning button illustrated in the figures comprises a head 10 having substantially a shape of revolution about an axis X and being mounted on an attachment base 11 like that described in document EP 889 564. The head 10 is mounted in an orifice made in a mounting plane Q (FIG. 1), by means of a seal 13, and so that the handle 20 is accessible manually and visually above this plane Q.

Beneath the base 11, at least one electric switch unit 12 is mounted, each electric unit 12 being assembled to the base 11 by coupling means such as those described in patent WO 97/2855. The head is fitted with a handle 20 that pivots about the axis of rotation X so as to adopt at least two functional positions, steady state or momentary action. Rotating the handle toward predetermined positions causes the electric switch units 12 to switch and an electric circuit to which these units are connected to be switched on.

The turning handle 20 has externally an outer cap 22 forming a disk 22B and a gripping tab 22A which extends as a protrusion, in a diametral plane. The tab 22A has an internal hollow space 23 and forms side faces 22C, 22D lit by a light source S. The external cap 22 is made of transparent or translucent plastic which allows the luminous flux emitted by the light source S to travel to the outside. The internal hollow space 23 of the gripping tab may have a shape which, seen in elevation, is substantially rectangular or trapezoidal.

The light source S forms part of a light unit that is mounted, like the electric units 12 onto the base 11, in the center, so that the source is centered on the axis X.

The cap 22, forming a monoblock assembly, covers a mechanical base 21 in the shape of a ring centered on X.

The handle 20 has, toward the underside, a collar 22E centered on the axis X and made of the same material as that of the cap 22 and a peripheral flanged edge 22F inserted into a flange 80. Between the flanged edge 23 and the central tubular collar 22 an annular chamber 24 is formed.

The collar 22E has a generally tubular shape and houses, on the inside, a rotary control actuator 50 while being assembled thereto particularly by snap-fitting 56, the two parts 20 and 50 being thus fixedly attached in rotation and translation.

The translucent or transparent plastic of the external envelope 22 may be colorless. The light source S emits a neutral or colored flux, the correlation between the color of light emission and the visual aspect offered by the button being provided by the base. The color of the light emitted by the source S and transmitted to the gripping tab 22 is correlated with that of the material of the base 21.

The translucent plastic of the outer envelope 22 may be colored, so as to allow the colored or neutral (white light) flux emitted by the source S to travel to the outside to the faces 22C and 22D.

The mechanical base 21 is made of an opaque plastic that is colored and mechanically strong so as to transmit forces—and withstand the wear resulting therefrom—to a control mechanism 40 housed beneath the handle in the annular space made in the flange 80. The mechanical base 21 has, on the underside, at least one cam or driving or actuating finger 25 interacting with the mechanism 40 to mark the positions of the handle. The base may comprise two fingers 25. Besides its mechanical function, the mechanical base 21 has a visual function.

Figure 3:
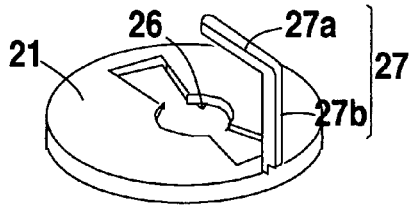
FIG. 3 represents, in perspective, the detail of the part called the mechanical base that is recessed and incorporated into the handle.
Figure 5:
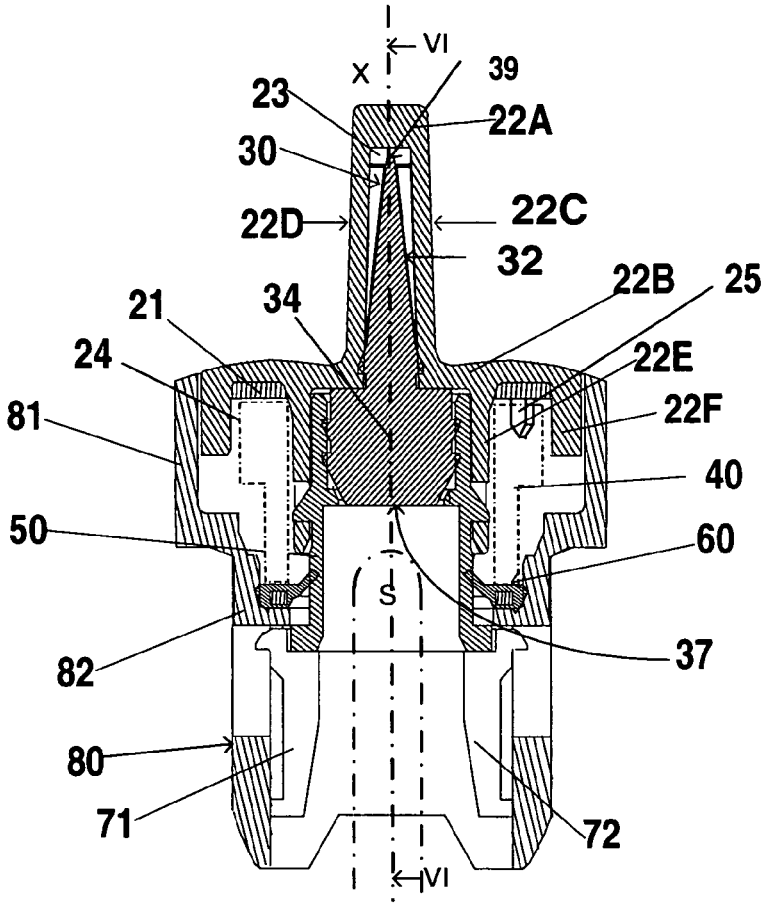
FIG. 5 is a section of an embodiment of the head of the luminous button.
Figure 6:
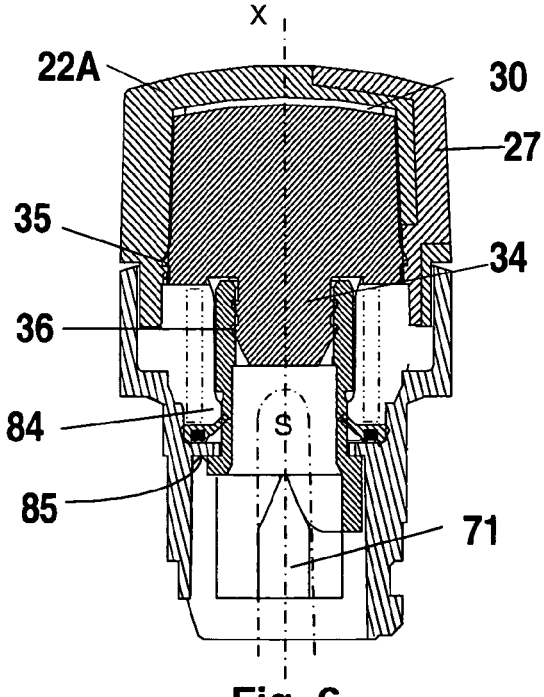
FIG. 6 is a section along VI-VI of FIG. 5.
Figure 7:
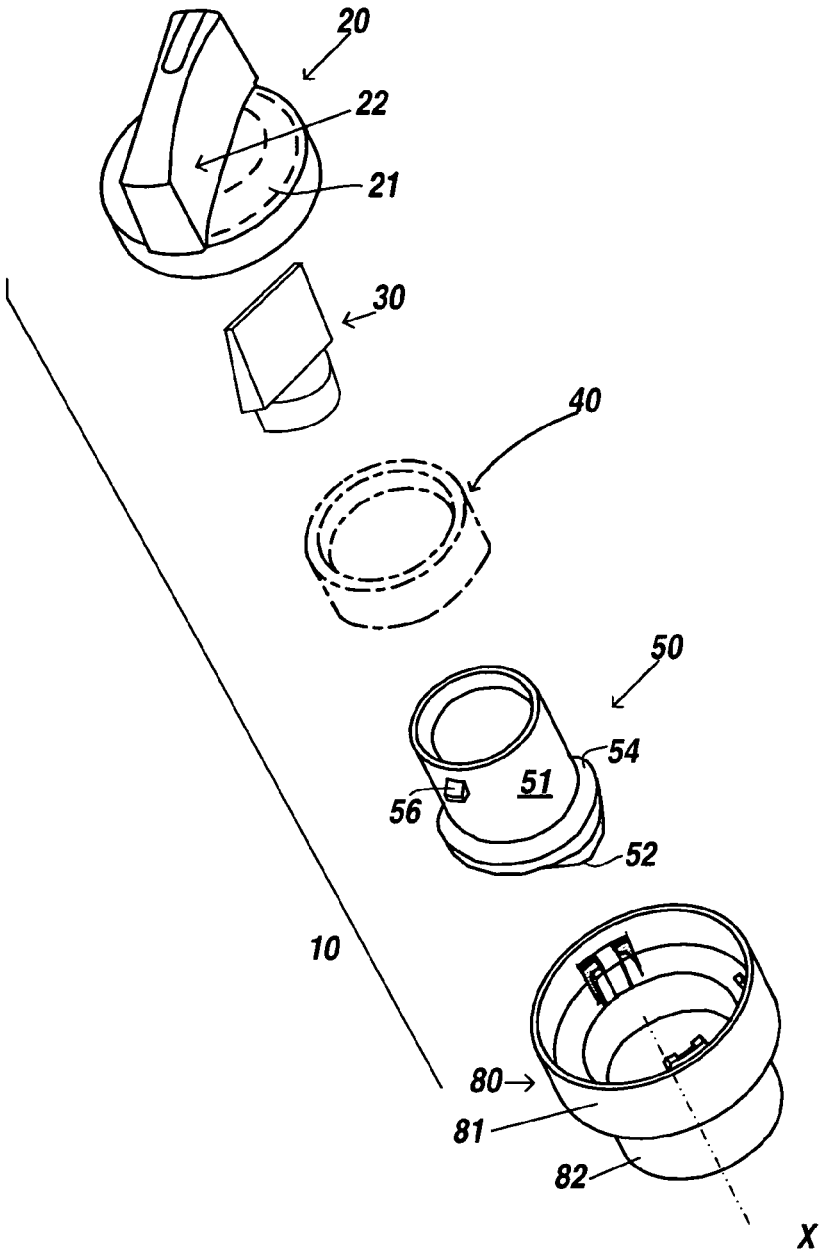
FIG. 7 is an exploded view of FIGS. 5 and 6.

The mechanical base 21 illustrated on its own in FIG. 3 has a generally annular shape and has a central through orifice 26 that is centered on the axis X and is suitable for the light guide 30, which extends in the internal hollow space 23, to pass through. The light source S illuminating the button is disposed along the axis X beneath the level of the mechanical base 21.

The handle 20 is advantageously made by double injection of the material of the mechanical base 21 (and of the pointer 27) and of the material of the external gripping cap 22.

The button houses a light guide 30 that is centered on the axis of rotation X and that has, facing the source S, a light entrance face 37 forming part of a unit 34, traverses the opaque mechanical base 21 via the central orifice 26 and has a light emitter 31 housed, on the top, in the hollow internal space 23 of the tab so as to diffuse the light to the sides.

The light emitter 31 is shaped like a prism or bevel delimited by two side faces 32 extending between two strips 33. The side faces 32 are inclined relative to the axis X, the space diminishing in the direction of propagation of the light. The emitter is bordered between the two faces 32 by a thin face 39. The diffusing side faces 32 refract the light and are preferably dulled to diffuse the light of the two sides of the tab.

The emitter or diffuser receives the light from the generally cylinder-shaped entrance unit 34, designed to be housed and attached at the bottom of the handle, at the top of the tubular actuator 50 and in the latter. On the side of the source S, the unit 34 has the entrance face 37 through which the light enters and is then conducted axially toward the tab in order to form a light concentrator and diffuser. The light exits via the side faces 32, the front face 38 and the thin face 39.

The light guide 30 is attached by interlocking or snap-fitting and in a sealed manner in the actuator 50 itself attached to the handle, the light emitter 31 itself being housed in a sealed manner in the hollow space of the tab.

The light guide or diffuser 30 is made of a material capable of transmitting the light. It is bordered on its periphery by a sealing strip 35. The unit 34 also has and at least one attachment and sealing strip 36. As an indication, the material forming the light diffuser 30 may be an elastomer.

The handle comprises a tab 22A, recessed into the latter, a display pointer 27, intended to indicate the angular position of the handle and having a color contrasting with that of the tab. Preferably, this pointer 27 is made of the same material as the mechanical base 21 and is molded together therewith.

The pointer 27 has at least one branch flush with the outer surface of the tab. It is given an L-shape with two branches 27*a*, 27*b* hugging the shape of the edge of the gripping tab and flush with the edges of the two sides of the tab, which sides, substantially horizontal and respectively vertical, border the internal space 23 of the tab.

The position display pointer 27 that is made with the same material as the base 21 has the same color as the latter. The pointer accentuates the correlation between the color of the light source and the visual aspect offered by the button. The base and the pointer that is attached thereto may therefore be invariable irrespective of the color provided for the light emission of the button and their color may thus remain the same for a whole range of buttons of varying colors.

The head comprises a generally cylinder-shaped flange 80 that has a cylindrical portion 81 in which the handle 20 is housed. This portion 81 is connected via a shoulder to a bottom portion 82 that comprises the rectilinear guides to guide the mobile cursors 71, 72 in translation, parallel to the axis X, in response to the rotation of the handle and of the actuator 50. The cursors 71, 72 are used to actuate the electric units 12. The external cylindrical flange 80 makes an annular housing 84 forming a bowl.

The handle 20 is fixedly attached to a tubular rotary actuator 50 whose central bore allows the light beam originating from the source S to pass through and which is provided with cam shapes 52 acting on at least one electric unit control cursor 71, 72.

The tubular rotary actuator 50 comprises a cylindrical tubular portion 51 that is snap-fitted close to one end onto a central collar 22E of the handle 20 and comprises at the other end cam shapes 52 to move the cursors. Between the cylindrical portion 51 and the cam shapes 52, it comprises a shoulder 54 that can press against a bearing face 85—transverse to the axis X—of the flange. The tubular portion 51 forms a cylindrical bearing surface that interacts with the seal 60 housed at the bottom of a bowl made in the flange 80 itself housing the handle.

Figure 8:
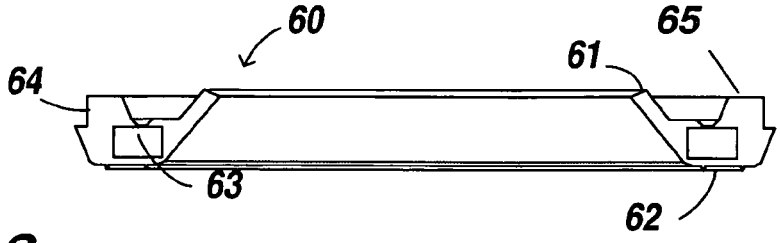
FIG. 8 is an axial section of an embodiment of the seal incorporated into the button.

The lip seal 60 illustrated in detail in FIG. 8 has a sealing lip 61 directed toward the axis X and in contact with the cylindrical portion 51, a rim 64 that fits against a side surface of the bowl 84, side faces 62 and 65 and a reinforcement 63 which is used to stiffen it.

The protection of the inside of the button against the ingress of dust or spray is therefore provided both by the seal 60 and by the sealing means of the light guide and diffuser 30.

It is well understood that, without departing from the scope of the invention, it is possible to imagine variants and enhancements of detail and even to envisage the use of equivalent means.

The light guide 30 could offer another appropriate shape in the space 23.

The invention claimed is:

1. A luminous turning button for an electric circuit, comprising:

a handle mounted to pivot about an axis to actuate at least one electric switch unit and that is illuminated by a light source substantially disposed along the axis, the handle including a cap, the cap including a disk portion and a gripping tab portion that protrudes in a diametric plane and delimits a hollow internal space;

an integrated mechanical base made of opaque material and covered by the handle;

a light diffuser element housed in the handle and that extends into the hollow space of the cap, and that conducts the light originating from the light source from beneath the integrated mechanical to the hollow internal space of the cap;

wherein the cap is made of translucent or transparent material capable of allowing light to travel to the outside, wherein the cap forms a monoblock assembly with its disk portion and its gripping tab portion, and the disk portion of the cap covers the integrated mechanical base, and wherein the integrated mechanical base includes an angular position display pointer made of the same material and molded as part of the integrated mechanical base, the angular position display pointer extending into the gripping tab portion of the cap.

2. The luminous turning button as claimed in claim 1, wherein the mechanical base is of generally annular shape and includes on its underside at least one actuation member interacting with a mechanism.

3. The luminous turning button as claimed in claim 2, wherein the light diffuser element includes a light entrance face, traverses the annular-shaped base via a central orifice aligned with the axis, and includes the diffusing side faces in the hollow internal space of the cap to diffuse the light to the sides.

4. The luminous turning button as claimed in claim 3, wherein the light emitter housed in the hollow internal space of the cap is shaped like a prism and receives the light from a light entrance unit attached to the bottom of the handle.

5. The luminous turning button as claimed in claim 3, wherein the light diffuser element is housed in the handle while being attached by interlocking or snap-fitting in a sealed manner to the handle, the light emitter itself being housed in a sealed manner in the hollow internal space of the cap.

6. The luminous turning button as claimed in claim 1, wherein the angular position display pointer is in a general shape of an L.

7. The luminous turning button as claimed in claim 1, wherein the handle is made by double injection of the material of the base and of the material of the cap.

8. The luminous turning button as claimed in claim 1, wherein the handle is fixedly attached to a tubular rotary actuator whose central bore allows the light originating from the light source to pass through and that includes cam shapes acting on at least one electric unit control cursor.

9. The luminous turning button as claimed in claim 8, wherein the tubular rotary actuator includes a tubular portion that is snap-fitted close to one end onto a central collar of the handle and includes at the other end the cam shapes to move the cursors.

10. The luminous turning button as claimed in claim 8, further comprising at a bottom a bowl made in a flange, itself housing the handle, and a seal including a lip pressing against the tubular actuator.

11. The luminous turning button as claimed in claim 10, wherein the seal is stiffened by a reinforcement.

12. The luminous turning button as claimed in claim 1, wherein the gripping tab is made of colorless translucent or transparent material, the color of the light emitted by the source and transmitted to the gripping tab being correlated with that of the material of the integrated mechanical base.

13. A luminous turning button for an electric circuit, comprising:

a handle mounted to pivot about an axis to actuate at least one electric switch unit and that is illuminated by a light source substantially disposed along the axis, the handle including a cap, the cap including a disk portion and a gripping tab portion that protrudes in a diametric plane and delimits a hollow internal space;

an integrated mechanical base made of opaque material and covered by the handle;

a light diffuser element housed in the handle and that extends into the hollow space of the cap, and that conducts the light originating from the light source from beneath the integrated mechanical base to the hollow internal space of the cap;

wherein the cap is made of translucent or transparent material capable of allowing light to travel to the outside, wherein the cap covers the integrated mechanical base, wherein the mechanical base is of generally annular shape and includes on its underside at least one actuation member interacting with a mechanism, and wherein the integrated mechanical base includes an angular position display pointer made of the same material and molded as part of the integrated mechanical base, the angular position display pointer extending into the gripping tab portion of the cap.

* * * * *